US006672220B2

(12) United States Patent
Brooks et al.

(10) Patent No.: US 6,672,220 B2
(45) Date of Patent: Jan. 6, 2004

(54) APPARATUS AND METHOD FOR DISPERSING MUNITIONS FROM A PROJECTILE

(75) Inventors: George W. Brooks, Orlando, FL (US); Mike S. Gagnier, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/852,796

(22) Filed: May 11, 2001

(65) Prior Publication Data

US 2002/0166475 A1 Nov. 14, 2002

(51) Int. Cl.[7] ..... F42B 12/60
(52) U.S. Cl. ..... 102/489; 102/357; 102/393
(58) Field of Search ..... 102/393, 498, 102/340, 342, 351, 357, 505

(56) References Cited

U.S. PATENT DOCUMENTS

| | | | | | |
|---|---|---|---|---|---|
| 603,525 | A | * | 5/1898 | Darmancier | 102/489 |
| 3,093,072 | A | * | 6/1963 | Pigman | 102/393 |
| 3,865,034 | A | * | 2/1975 | Boulter et al. | 102/489 |
| 4,488,489 | A | * | 12/1984 | Schoffl | 102/489 |
| 4,558,645 | A | | 12/1985 | Boeder et al. | 102/489 |
| 4,714,020 | A | | 12/1987 | Hertsgaard et al. | 102/489 |
| 4,750,423 | A | | 6/1988 | Nagabhushan | 102/489 |
| 4,807,534 | A | * | 2/1989 | Vockensperger et al. | 102/489 |
| 4,829,905 | A | | 5/1989 | Lew et al. | 102/489 |
| H699 | H | * | 11/1989 | Thomas, Sr. | 102/489 |
| 5,005,481 | A | | 4/1991 | Schneider et al. | 102/489 |
| 5,005,483 | A | * | 4/1991 | Deffayet | 102/489 |
| 5,033,390 | A | | 7/1991 | Minert et al. | 102/530 |
| 5,040,465 | A | * | 8/1991 | Maury | 102/489 |
| 5,078,053 | A | | 1/1992 | Denis | 102/489 |
| 5,094,170 | A | | 3/1992 | Raynaud et al. | 102/489 |
| 5,107,767 | A | | 4/1992 | Schneider et al. | 102/489 |
| 5,225,627 | A | | 7/1993 | Phillips et al. | 102/351 |
| 5,907,117 | A | | 5/1999 | Persson et al. | 102/489 |

FOREIGN PATENT DOCUMENTS

| | | | | |
|---|---|---|---|---|
| DE | 3026159 | * | 8/1982 | 102/489 |

OTHER PUBLICATIONS

"Auto Airbag Adapted to Dispersing Submunitions", Edited by Bruce Firsch and Victor Wigotsky, Astronautics & Aeronautics, Sep. 1983; pps. 28–29.

"Naval Guns: Can They Deliver", National Defense, Mar. 2001.

* cited by examiner

*Primary Examiner*—Harold J. Tudor
(74) *Attorney, Agent, or Firm*—Burns, Doane, Swecker and Mathis, LLP

(57) ABSTRACT

The invention relates to methods and apparatus for dispersing munitions from a projectile using an expandable device. Exemplary embodiments are directed to an apparatus for dispersing munitions from a projectile which includes a case, and a core within the case including a plurality of munitions. At least one expandable device is in operative communication with at least one of the munitions, and multiple gas generators are associated with the at least one expandable device. Another embodiment of the invention is directed to a method for dispersing munitions from a projectile which includes separating a case from a core of the projectile, then, after a delay, activating at least one gas generator to deploy plural munitions using an expandable device.

20 Claims, 8 Drawing Sheets

APPARATUS AND METHOD FOR DISPERSING MUNITIONS FROM A PROJECTILE

BACKGROUND OF THE INVENTION

1. Field of the Invention

The invention relates to an apparatus and method for dispersing munitions, and more particularly, to dispensing munitions from a projectile during flight.

2. Background Information

Spinning projectiles such as artillery shells have traditionally been used as submunition dispersing systems to passively dispense submunitions over a large area. While the projectile is in flight, submunitions are released from the projectile and are passively dispersed by the centripetal forces of the spinning projectile. The spinning submunition dispersion systems typically do not include an active dispersal system. A submunition dispersing system for a spinning air-launched carrier is disclosed in U.S. Pat. No. 4,750,423, issued to Nagabhushan.

Non-spinning projectiles, typically use an active submunition dispersal system to actively disperse submunitions. For example, inflatable air bag submunition dispersal systems are discussed by Victor Wigotsky et al. in a document *Auto Airbag Adapted to Dispersing Submunitions*, Astronautics and Aeronautics, September 1983, at p. 28–30, the disclosure of which is hereby incorporated by reference in its entirety. Dispersing systems are also disclosed in various patents. U.S. Pat. No. 5,033,390 (Minert), discloses a gas generator to inflate an air bag and disperse submunitions. U.S. Pat. No. 4,714,020 (Hertsgaard et al.), illustrates a gas generator device for use in a forced dispersion munitions dispenser. In U.S. Pat. No. 4,588,645, a submunition dispersion system is disclosed which applies an explosive charge to the skin of the warhead, and uses a number of axially inflating airbags for dispersing the submunitions. U.S. Pat. Nos. 5,107,767 and 5,005,481 (Schneider et al.) illustrate a submunition dispersing system using bladders and gas generators to rupture the skin of a missile and disperse subpacks of munitions during flight. In U.S. Pat. No. 5,225,627 (Phillips et al.), an air bag and gas generator are located within a projectile. When the gas generator inflates the air bag, the submunitions are pushed through the skin of the projectile and fall from the projectile. The air bag and gas generator are located along a center axis of the projectile. The disclosures in all of the foregoing patents are hereby incorporated by reference in their entirety.

Use of gun-launched projectiles for dispersing submunitions over longer distances is discussed in Sandra I. Irwin, *Naval Guns: Can They Deliver?*, National Defense, March 2001, at p. 20–22, incorporated by reference herein in its entirety.

It would be desirable to fire non-spinning projectiles without having to reduce the payload of munitions to accommodate the use of a reduced volume core and, in so doing, to provide a dispersal system for the munitions.

SUMMARY OF THE INVENTION

The present invention relates to methods and apparatus for dispersing munitions from a projectile using an expandable device. Exemplary embodiments are directed to an apparatus for dispersing munitions from a projectile which comprises a case, and a core within the case including a plurality of munitions. At least one expandable device is in operative communication with at least one of the munitions, and multiple gas generators are associated with the at least one expandable device.

An interior surface of the case can be shaped to conform to the outer surfaces of the plurality of munitions.

The expandable device can comprise an inflatable bag for dispersing the at least one munition radially outward from a central axis of the core in response to activation of a gas generator. The inflatable bag can have multiple expansion lobes. For example, the inflatable bag can have two expansion lobes. In another embodiment, the apparatus can include a plurality of interconnected inflatable bags.

The apparatus can include at least one gas generator within each of the multiple expansion lobes of the inflatable bag. The munitions can be arranged about each of the multiple expansion lobes of the inflatable bag. In an exemplary embodiment, a first set of munitions are arranged about a first of the multiple expansion lobes, and a second set of munitions are arranged about a second of the multiple expansion lobes of the inflatable bag. In another embodiment, a first set of munitions are arranged about a first of the multiple expansion lobes, and a second set of munitions are arranged about a second of the multiple expansion lobes of the inflatable bag, with at least one of the munitions being located between the expansion lobes.

The apparatus can include separating means for separating the case from the core. For example, the separating means can include an explosive charge adjacent to an interior wall of the case. The separating means can include a propellant charge for moving the case away from the central core in a direction substantially parallel to a longitudinal axis of the case.

In an exemplary embodiment, the core can contain material placed about each of the plurality of munitions. For example, polypropylene material can be placed about each of the plurality of munitions.

In exemplary embodiments, the case of the apparatus has a substantially cylindrical shape, and the apparatus further includes at least one fin to stabilize the apparatus in flight. The apparatus can further comprise a forward section coaxial with and attached to the case, and a rearward section, coaxial with and attached to the core.

BRIEF DESCRIPTION OF THE DRAWINGS

Other objects and advantages of the present invention will become apparent to those skilled in the art upon reading the following detailed description of the preferred embodiments, in conjunction with the accompanying drawings, wherein like reference numerals have been used to designate like elements, and wherein.

DETAILED DESCRIPTION OF THE PREFERRED EMBODIMENTS

Figure 1A:
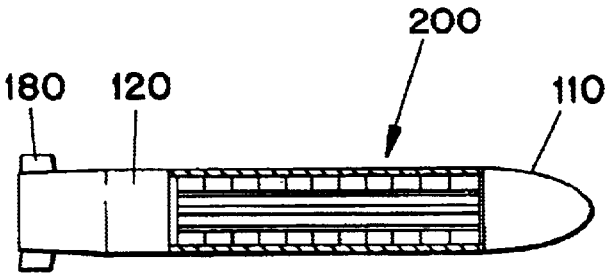
FIGS. 1*a*–1*c* are partial cross sectional views of an apparatus for dispersing munitions from a projectile according to an exemplary embodiment the invention.
Figure 1B:
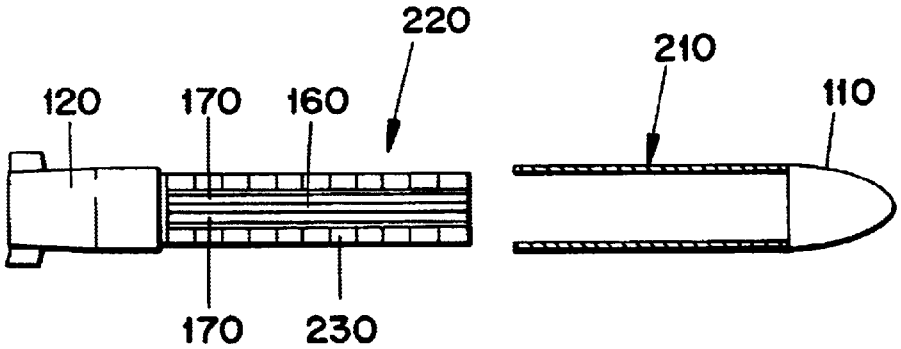
Figure 1C:
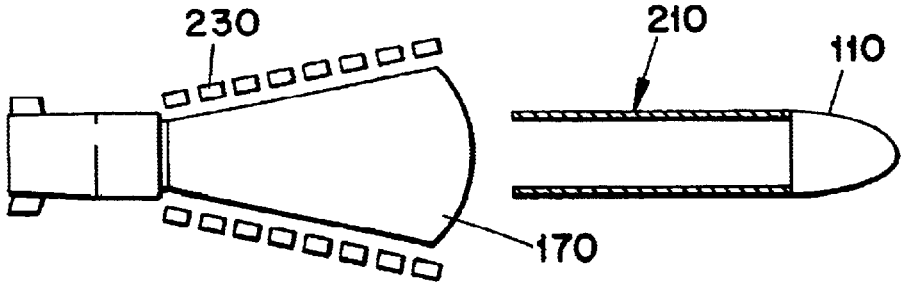

FIGS. 1*a*, 1*b*, and 1*c* illustrate an apparatus for dispersing munitions from a projectile. The FIG. 1*a* apparatus 200, is shown between and axially aligned with a forward section 110 a rearward section 120 in a projectile, although the apparatus 200 can be placed at any desired location.

The apparatus 200 includes a case 210 and a core 220. The core 220 includes at least one munition 230, multiple gas generators 160, and at least one expandable device 170.

In an exemplary embodiment, the projectile can be configured as a non-spinning projectile. Fins, such as those shown as 180 in FIG. 1, can be used to stabilize the projectile in flight. It will be appreciated that fins can be any device used to stabilize a projectile in flight.

The term munitions is used herein to refer to any objects packaged within a projectile which are intended to be delivered from (i.e. expelled from) a projectile. Munitions can be any type of object, including, but not limited to, submunitions such as smoke grenades and/or explosive devices, or other objects.

The expandable device 170 can be any configuration which will displace munitions away from the core.

The multiple gas generators 160 can be any type of generator which is capable of generating gas sufficient to inflate the expandable device 170. The multiple gas generators 160 can be located within the expandable device 170, or may be outside the expandable device 170 with a gas flow apparatus used to direct gas from the gas generators 160 to the expandable device 170. A single gas generator 160 can also be used with a gas flow apparatus to direct the gas into each of multiple expansion lobes of an expandable device 170.

Figure 2:
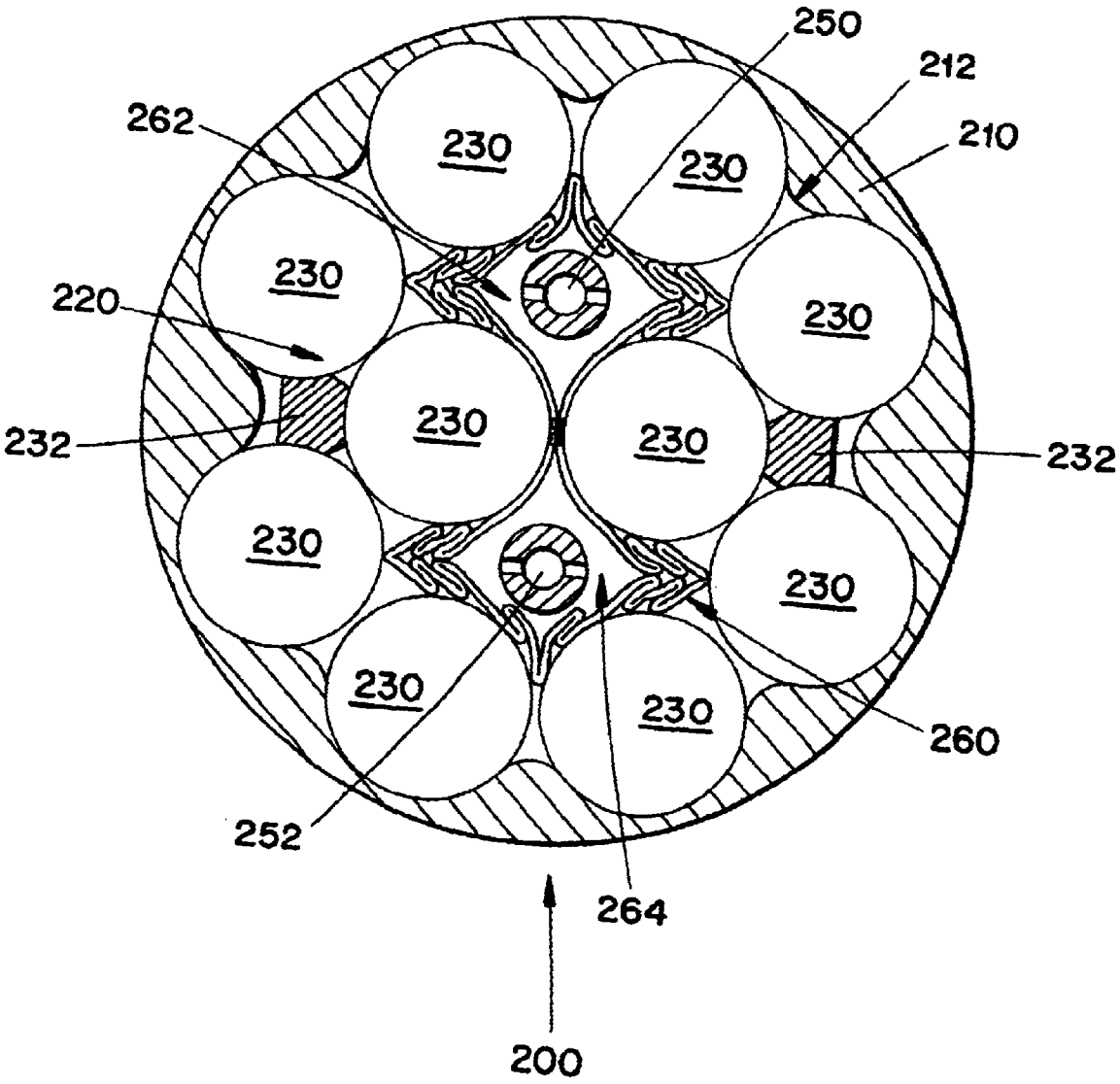
FIG. 2 is a cross sectional view of an apparatus for dispersing munitions according to an exemplary embodiment of the invention.

FIG. 2 is a cross sectional view of an apparatus 200 for dispersing munitions according to an exemplary embodiment of the invention. The core 220 of the apparatus 200 is contained within the case 210. The core 220 has least one expandable device 260 in operative communication with at least one munition 230. Multiple gas generators can be associated with at least one expandable device.

In an exemplary embodiment, interior wall 212 of the case 210 includes a surface which is at least partially shaped to conform to the outer surfaces of the plurality of munitions 230. An advantage of the shaped interior wall 212 is that movement of the munitions 230 is inhibited during transportation. Further, the shaped interior wall results in additional structural support during the high acceleration forces experienced during launch, which can reach, for example, on the order of 10,000–30,000 times the force due to gravity on Earth, or lesser or greater. Alternatively, the case 210 can have any desired interior surface shape, and need not conform to the surface of the munitions. Regardless of the interior surface shape of the case, additional structure or material can be placed between the interior wall 212 and the munitions 230 to hold the munitions in place, absorb shock, and prevent rattling. Material 232 can also be placed between the munitions 230 as dunnage to hold the munitions in place and prevent movement. An example of a suitable material for this application is polypropylene foam.

The case 210 shown in FIG. 2 is cylindrical in shape, although other shapes suitable for flight can also be used.

The expandable device 260 can be any type of suitable device, such as, for example, the inflatable bag shown at 260 in FIG. 2. Activation of multiple gas generators 250, 252, causes the gas generator to release expanding gases into the inflatable bag 260.

The inflatable bag 260 can be of any shape and material suitable to disperse munitions in a radial direction. The inflatable bag 260 is sized so that upon inflation, it expands enough to disperse the munitions 230 over a target area. The size and contour of the inflatable bag 260 can be chosen to impart the desired amount of velocity to the munitions 230. In an exemplary embodiment, the length of the inflatable bag 260 is approximately equal to the length of the core 320, although the bag can be shorter or longer than the core 320 in an alternative embodiment. The inflatable bag 260 can be cylindrical in shape, with a constant diameter along its length, or can be of any desired shape (e.g. spherical), to disperse the munitions 230 in a desired pattern. An inflatable bag 260 which is tapered to have a larger diameter at a forward end can be used to impart a higher velocity to the munitions closest to the forward end of the core, resulting in fewer collisions between munitions. U.S. Pat. No. 5,005,481, to Schneider et al, incorporated herein in its entirety, discloses several suitable inflatable bag shapes which can be used.

The inflatable bag 260 can be formed of a sufficiently strong material to resist tearing under the anticipated loads to be encountered when the inflatable bag 260 is inflated. An example of a material which can be used for the inflatable bag is Dupont's aramid (Kevlar) fiber, although numerous other alternatives exist.

In an exemplary embodiment, the material of the inflatable bag 260 is folded to form multiple expansion lobes such as the exemplary expansion lobes 262, 264 in FIG. 2. The expansion lobes are the locations at which expansion of the inflatable bag originates. When a gas, generated by the gas generators, is released at the expansion lobes, the gas exerts pressure on the material of the inflatable bag 260. As the inflatable bag 260 expands, it applies pressure on the munitions 230 and displaces them outward from the central axis of the core.

The expandable device can, of course, have other configurations. In another embodiment, the expandable device comprises a plurality of interconnected inflatable bags. The inflatable bags can be interconnected by webbing attached to each bag, by direct connections of a portion of the bags, or by other suitable means.

Figures 3A, 3B:
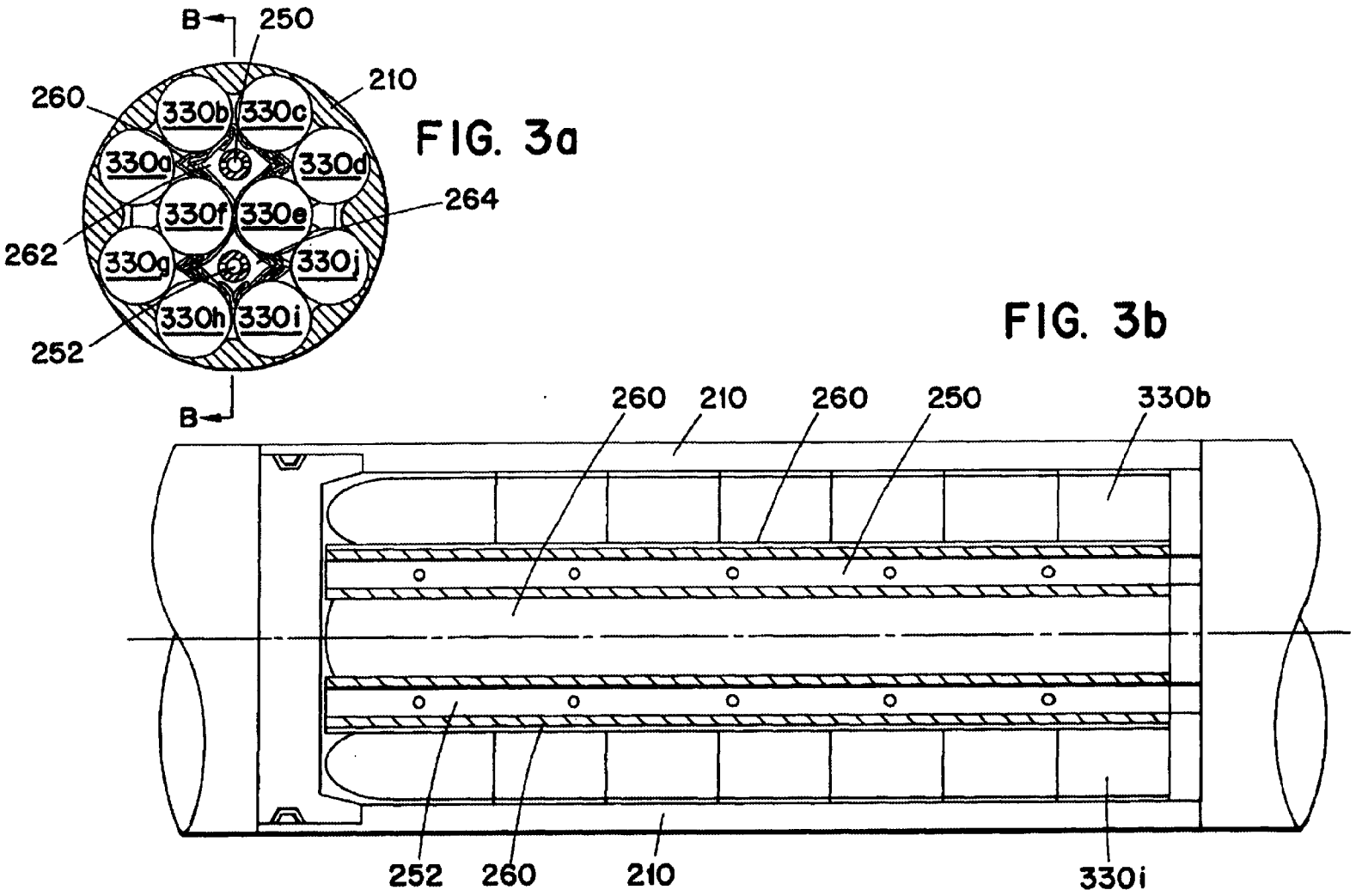
FIG. 3*a* is a cross sectional view of the apparatus for dispersing munitions according to an exemplary embodiment of the invention.
FIG. 3*b* is a longitudinal sectional view taken along the line B—B of FIG. 3*a*.

In an exemplary embodiment shown in FIGS. 3*a* and 3*b*, at least one gas generator is disposed within each of the multiple expansion lobes of the inflatable bag. FIGS. 3*a* and 3*b* illustrate a case 210 and a plurality of munitions 330*a*–330*i* arranged about two gas generators 250 and 252, and an inflatable bag 260 in operative communication with at least one of the plurality of munitions 330. The material of the inflatable bag 260 is folded around the gas generators 250 and 252 to form expansion lobes 262 and 264. The munitions 330 can be arranged in stacks, for example, with an end of one munition fitting within a recess of an adjacent munition.

The plurality of munitions 330*a*–330*i* are arranged around each of the multiple expansion lobes 262 and 264. A first set of munitions, indicated as 330*a*, 330*b*, 330*c*, 330*d*, 330*e*, and 330*f* is arranged about the first expansion lobe 262. A second set of munitions, indicated as 330*e*, 330*f*, 330*g*, 330*h*, 330*i*, and 330*j* is arranged about the second expansion lobe 264. As the gas inflates the expansion lobes 262, 264 of the inflatable bag, the material of the inflatable bag 260 is forced outward, and the munitions 330*a*–330*i* are displaced in a radial direction outward from the central axis of the core.

The cross sectional view of FIG. 3*a* also illustrates an advantage of the locating two gas generators 250, 252 within the expansion lobes of an inflatable bag 262, 264. Ten munitions 330*a*–330*i*, each 1½ inches in diameter, are arranged around two gas generators 250, 252 inside a case 210 with a six-inch outer diameter. Eight munitions are arranged in an outer region inside the case 210, and two munitions are arranged in a central region with the inflatable bag 260 and the gas generators 250, 252. For comparison, if a single gas generator and air bag were arranged along a central axis of the core, only eight similarly sized munitions would fit around the gas generator within a case of the same diameter as the case 210 of the FIGS. 3*a* and 3*b* embodiment. Thus, the use of two gas generators in the FIGS. 3*a* and 3*b* embodiment provides an increase in payload (e.g. on the order of 22%, or less or greater, as desired) over a single central-axis gas generator configuration.

In another exemplary embodiment, at least one of the munitions is located between the multiple expansion lobes. As an example, in FIG. 3*a*, munitions 230*e* and 230*f* are located between expansion lobes 262 and 264.

The gas generators can be of any type suitable to produce gas to expand the expandable device. The gas generators can be of any type suitable for generating gas for expanding the expandable device. For example, the gas generators can be dispersive gas generators comprising a housing, a solid propellant material, and nozzles or perforations in the housing through which the gas can flow.

Figure 4:
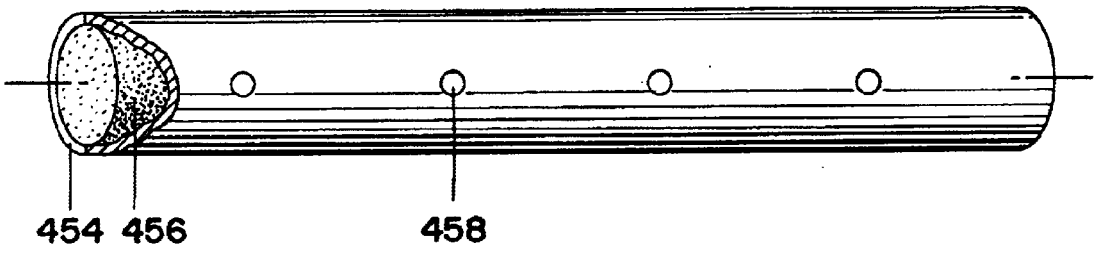
FIG. 4 illustrates an exemplary gas generator suitable for use in an exemplary embodiment of the invention.

In an embodiment shown in FIG. 4, a dispersive gas generator suitable for use in an exemplary embodiment of the invention includes a cylindrical housing 454, a propellant 456 contained within the housing, and perforations or nozzles 458 in the housing to allow the gases to flow from within the housing. Examples of gas generators which are generally suitable to be used are disclosed in U.S. Pat. No. 5,255,627 (Minert), which is incorporated herein by reference. Although the type of propellant 456 is not critical to the invention, propellants are usually in the form of grains or pellets. Suitable propellant materials include HTPB, CTPB, rubber ammonium, and the azide family of propellants, or any other desired propellant or gas.

Figure 5A:
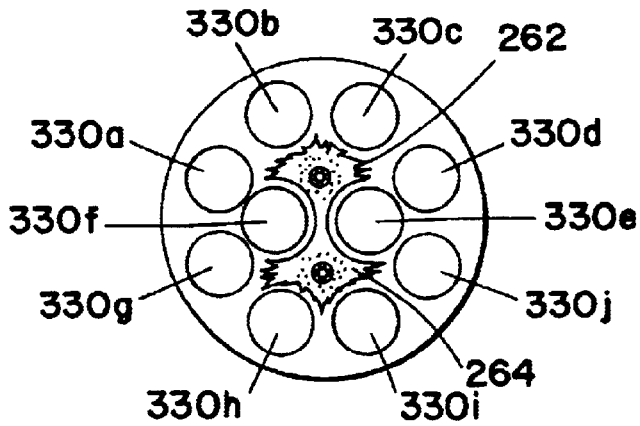
FIGS. 5*a*, 5*b*, and 5*c* are cross sectional views of dispersal of munitions from a projectile according to an exemplary embodiment of the invention.
Figure 5B:
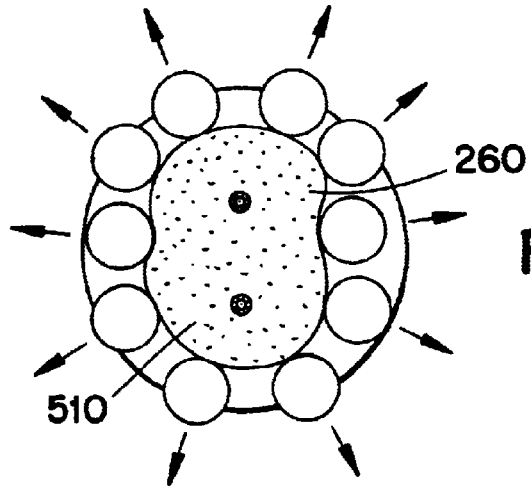
Figure 5C:
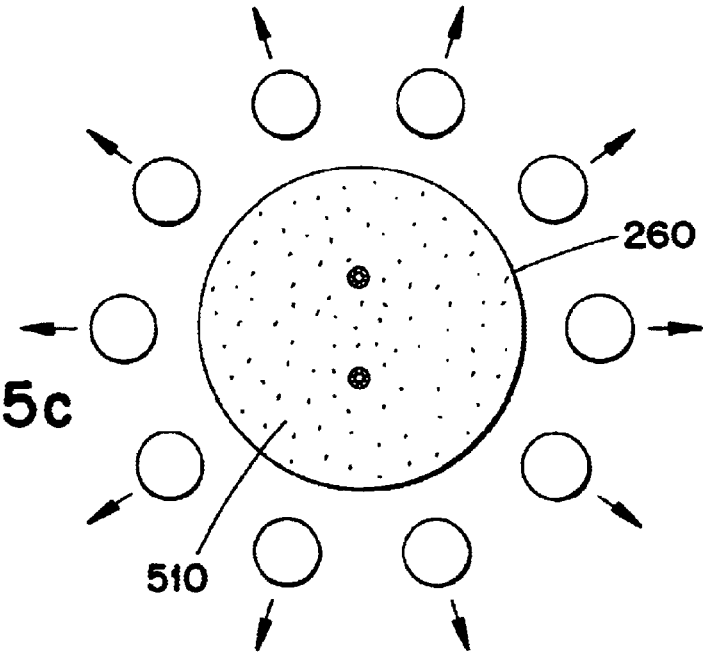

In another exemplary embodiment illustrated in FIGS. 5*a*–5*c*, as the gas 510 inflates the expansion lobes 262, 264 of the inflatable bag 260, the material of the inflatable bag 260 is forced outward, and the munitions 330*a*–330*i* are displaced in a radial direction outward from the central axis of the core.

The invention disclosed herein also encompasses a method for dispersing multiple munitions from a projectile having at least one gas generator, multiple munitions, and an expandable device. The method includes separating the case from the core and, after a delay, activating at least one gas generator to deploy multiple munitions using an expandable device.

Refer again to FIGS. 1*a*–1*c* for an illustration of another exemplary embodiment of the invention. As shown in FIGS. 1*a*–1*c*, the case 210 is separated from the core 220 before the munitions 230 are dispersed by the expandable device 170 to reduce the likelihood that munitions will be damaged during dispersal. In this manner, the munitions 230 can be dispersed over a target area without damage to the munitions 230. Separation can be accomplished by various separation means including, for example, explosive charges used to cut the case.

Figure 6:
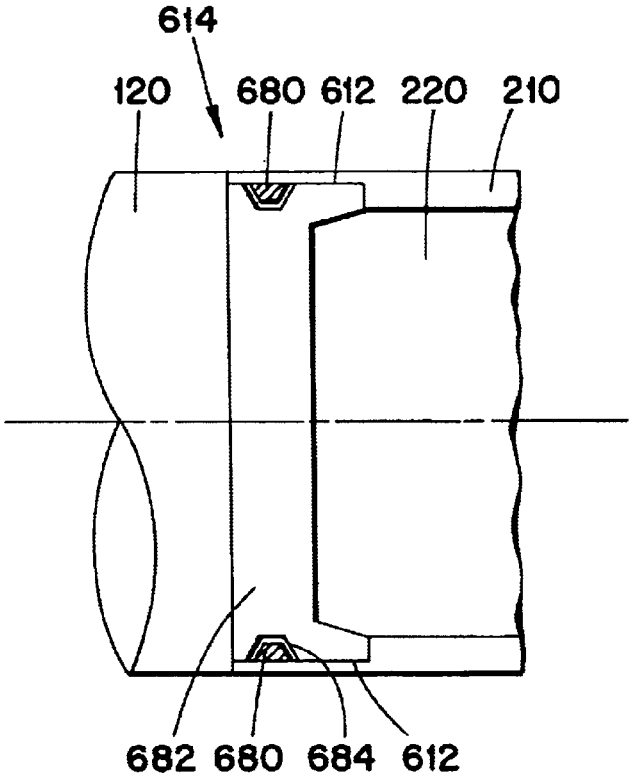
FIG. 6 is an longitudinal section view of an aft end of the apparatus according to an exemplary embodiment of the invention.

In an exemplary embodiment of the invention shown in FIG. 6, separating the case 210 from the core 220 can be accomplished by igniting an explosive charge 680 within the core. As shown in FIG. 6, the explosive charge 680 can be located adjacent to the interior wall of the case 210 for severing or cutting the case 210. The explosive charge 680 can be located inside the case 210, at an aft end 614 of the case 210 near the location where the case 210 joins the rearward section 630 of the projectile. The aft end 614 of the case 210 can be formed thinner than the remainder of the case 210. The explosive charge 680 shown herein is a cutting charge, and specifically is linear shaped charge laid circumferentially along the inside wall of the case to explosively sever the connection between the rearward section 120 and the case 210. A linear shaped charge can be arranged to release energy in one direction only. The explosive charge 680 is outwardly facing, so it releases energy outward toward the case 210, with very little energy released in the direction of the munitions and other components within the case. A groove 684 in an aft bulkhead 682 holds the explosive charge 680 in place against the interior wall 612 of the case 210. An example of a suitable linear shaped charge is the described in U.S. Pat. No. 5,827,995 (Graham). The invention, however, is not limited to the use of a linear shaped charge, and any other mechanical or explosive device with sufficient strength to cut the case away from the core can be used.

Thus, in an exemplary embodiment of the method for dispersing multiple munitions within a projectile, the step of separating the case from the core comprises igniting a cutting charge. In another exemplary embodiment, the cutting charge can be a flexible linear shape charge aligned to release energy toward the interior wall of the case.

Figure 7B:
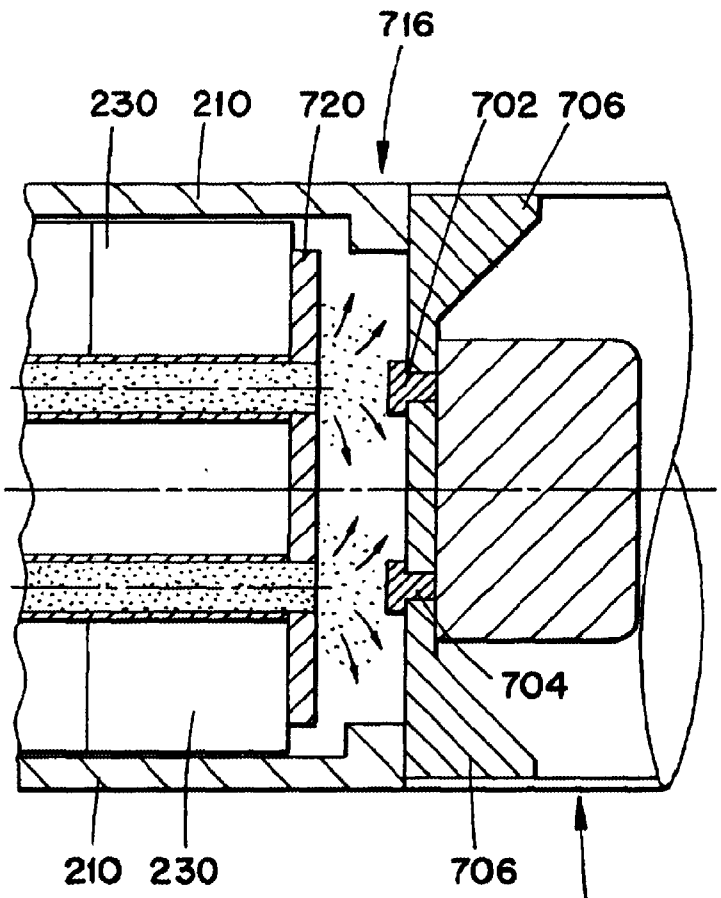
FIGS. 7*a* and 7*b* are longitudinal sectional views of a forward end of the apparatus according to another exemplary embodiment of the invention.
Figure 7A:
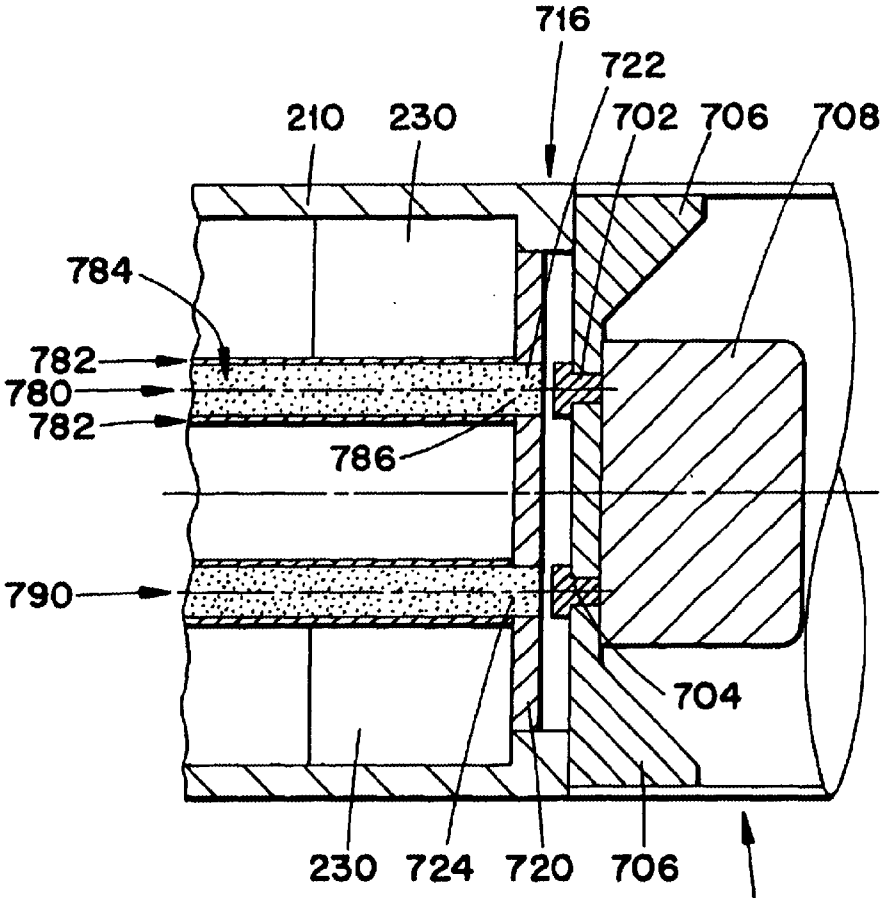

In another exemplary embodiment, the separating means includes a propellant charge for moving the case away from the core in a direction substantially parallel to a longitudinal axis of the case, or in any other desired direction. The forward end of an exemplary embodiment of the apparatus is shown in FIGS. 7*a* and 7*b*. After the case has been severed, a separation charge 784, contained in expulsion gas generator 780, is used to further separate the case 210 from the core 716 containing munitions 230.

Referring first to FIG. 7*a*, at the forward end of the apparatus, an expulsion plate 720 has openings 722, 724 aligned with each of two expulsion gas generators 780, 790. The outer circumference of the expulsion plate 720 fits closely within the interior wall of the case 210, however, is not fixed to the case 210, so the expulsion plate 720 can be moved from its position inside the case 210 by applying pressure in an axial direction. A forward section bulkhead 706 is fixedly attached at its circumference to the forward end 716 of the case 210. The expulsion gas generator 780 has a housing 782 and a propellant charge 784 within the housing 782, with an opening 786 through which gas can flow.

As shown in FIG. 7*b*, when the propellant charge 784 is initiated, the expulsion gas generator 780 generates gas by burning the propellant charge 784, and the gas is expelled through an opening 722 in the expulsion plate 720 into a cavity formed by the expulsion plate 720 and the forward section bulkhead 706. The expanding gas exerts pressure on the expulsion plate 720 and the forward section bulkhead 706, causing them to be displaced away from each other in a direction substantially parallel to the longitudinal axis of the case 210.

As the forward bulkhead 706 moves away from the expulsion plate 720, the case 210 and the forward section 110 of the projectile, which are fixed to the forward bulkhead 706, slide completely away from the munitions 230. This separation of the case 210 from the munitions 230 will allow the munitions 230 to be dispersed without striking the case 210. Initiators 702, 704 initiate ignition of the propellant charges in each expulsion gas generator 780, 790 through the openings 722, 724, in the expulsion plate 720.

In another exemplary embodiment of a method for dispersing munitions from a projectile, the step of separating the case from the core comprises igniting a propellant charge. In exemplary embodiments, the propellant charge can be located at a forward area of the core. In another exemplary embodiment, the step of separating the case from the core includes igniting a cutting charge within the core.

The forward section 110 can also contain a safe and arming device 708, for preventing unwanted initiation of systems within the projectile before predetermined launch parameters are met. The safe and arming device 708 typically senses launch parameters such as velocity and altitude of the projectile, and prevents initiation unless the launch parameters are within an predetermined range. The safe and arming device 708 can be in communication with initiators for the expulsion gas generators 702, 704 and with initiators (not shown) for the explosive charge (element 680 of FIG. 6).

To ensure munitions are not dispersed until after the core has been separated from the case, in another exemplary embodiment, delay elements can be used to delay inflation of the expandable device until after a preset time period. The delay element can be any type of chemical/pyrotechnic, mechanical, and/or electrical timing device which will delay activation of the expandable device until the case has cleared the core.

The delay between the separation of the case from the core and the activating of at least one gas generator can be any desired time period, such as a time period sufficient to allow the case to be moved away from the path of munitions. In an exemplary embodiment, the time delay is a few milliseconds. In an exemplary embodiment, the delay element is a relatively slow-burning propellant which is ignited by the propellant charge located at the forward end of the core containing munitions, and which ignites the propellant within the gas generators.

Figure 8:
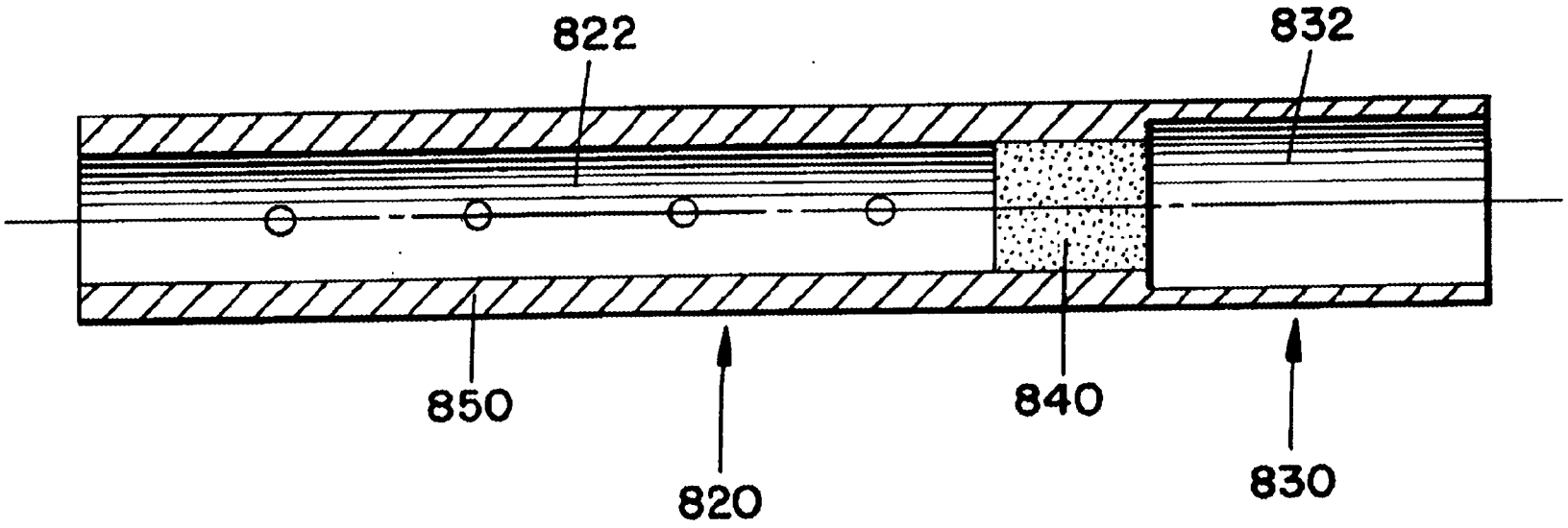
FIG. 8 is a longitudinal sectional view of a dispersive gas generator integrated with a delay element and an expulsion gas generator suitable for use in an exemplary embodiment of the invention.

FIG. 8 illustrates a delay element 840 integrated with a dispersive gas generator 820 and an expulsion gas generator 830 in a single housing 850, suitable for use in an exemplary embodiment of the invention. The delay element 840 is a solid, relatively slow-burning, propellant material located between the expulsion gas generator 830 and the dispersion gas generator 820. The propellant material of the delay element 840 is ignited by the propellant charge 832 within the expulsion gas generator 830. After the time required to burn the propellant material of the delay element 840, the propellant material of the delay element 840 ignites the propellant 822 within the dispersion gas generator 820. Those of skill in the art will appreciate that the delay element can be configured to delay the initiation of the dispersion gas generator by any desired time period, and that any of many different delay elements and means can be used.

Thus, in another exemplary embodiment of a method for dispersing munitions from a projectile, after a delay, two gas generators are activated to deploy multiple munitions using an expandable device. The gas generators can be activated simultaneously to achieve uniform dispersion of the munitions.

Figure 9A:
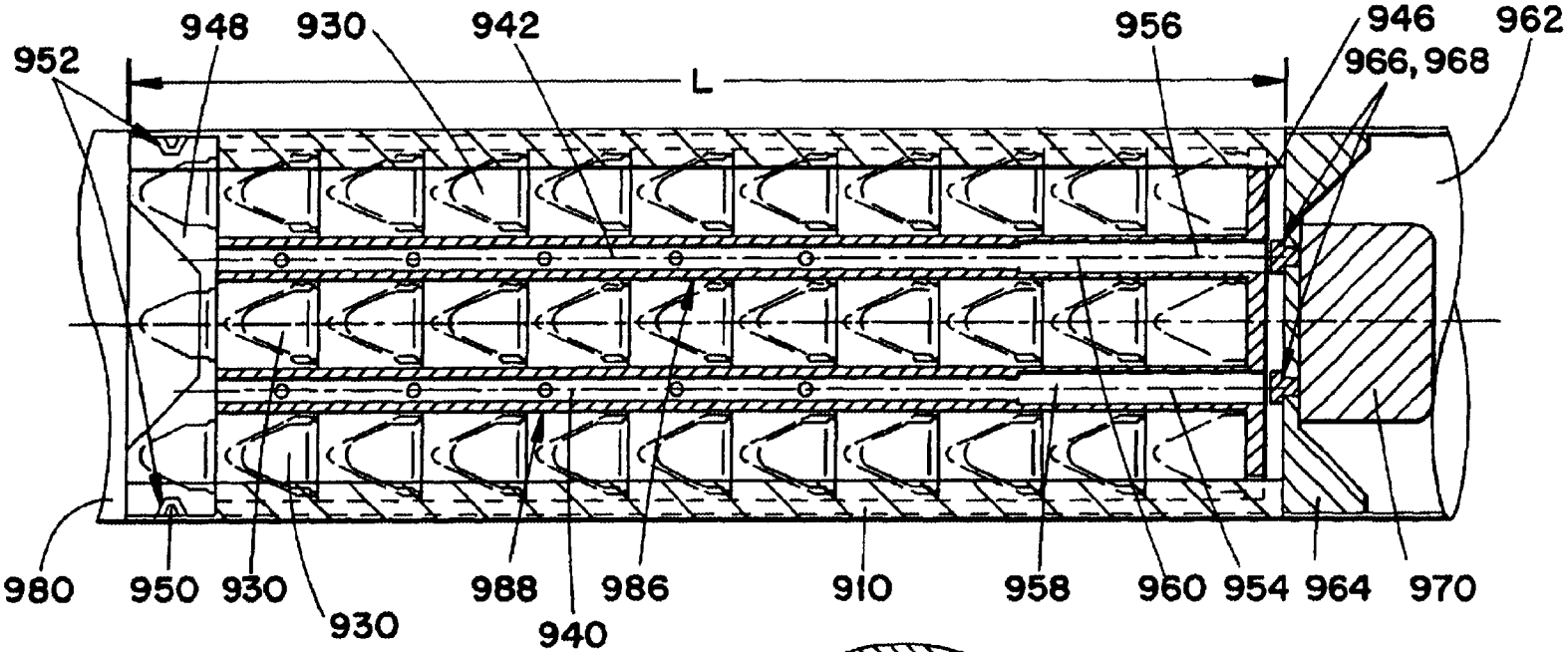
FIGS. 9*a* and 9*b* are longitudinal and cross sectional views of an exemplary embodiment of the invention.

FIG. 9*a* is a longitudinal cross sectional view of another exemplary embodiment. In the FIG. 9*a* embodiment, the case 910 surrounds a core, containing munitions 930, two dispersion gas generators 940, 942, an expulsion plate 946, an aft bulkhead 948, an explosive charge 950 disposed within a groove 952 in the in the aft bulkhead 948, expulsion gas generators 954 and 956, and pyrotechnic delay elements 958 and 960. Each axially aligned set of dispersion gas generators, pyrotechnic delay elements, and expulsion gas generators are contained within each gas generator tube 986, 988, respectively. A forward section 962 of the projectile has a forward bulkhead 964, initiators 966 and 968, and a safe and arming device 970. The rearward section 980 of the projectile is attached to the aft bulkhead 948. The length of the core, or "payload length", is shown as L.

Figure 9B:
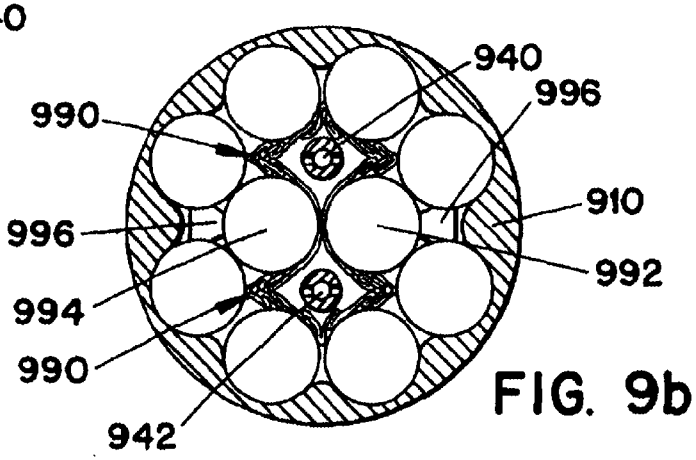

FIG. 9*b* is a cross sectional view of the exemplary embodiment of FIG. 9*a*. An inflatable bag 990 with two expansion lobes is shown folded around two gas generators 940, 942. Two centrally located munitions 992 and 994 are shown between the expansion lobes. Material 996 is placed between the munitions as dunnage. The interior surface of the case 910 is at least partially shaped to match the shape of the munitions 930.

In another exemplary embodiment, after a delay, two gas generators are activated to deploy multiple munitions using an expandable device. The gas generators can be activated simultaneously to achieve uniform dispersion of the munitions.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive, and the scope of the invention is to be determined by reference to the appended claims.

What is claimed is:

1. An apparatus for dispersing munitions from a projectile comprising:

a case;

a core within the case, including a plurality of munitions, at least one expandable device in operative communication with at least one of the munitions, and multiple gas generators associated with the at least one expandable device;

an explosive charge for separating the case from the core, the explosive charge being arranged circumferentially along an interior wall of the case; and a propellant charge for moving the case away from the core in a direction substantially parallel the longitudinal axis of the case.

2. An apparatus as in claim 1, wherein the interior surface of the case is shaped to conform to the outer surfaces of the plurality of munitions.

3. An apparatus as in claim 1, wherein the core comprises: material placed about each of the plurality of munitions.

4. An apparatus as in claim 3, wherein the material is polypropylene foam.

5. An apparatus as in claim 1, wherein the case has a substantially cylindrical shape, the apparatus further including:

at least one fin to stabilize the apparatus in flight.

6. An apparatus as in claim 1, comprising:

a front section coaxial with and attached to the core; and an aft section, coaxial with and attached to the core.

7. An apparatus as in claim 1, wherein the at least one expandable device comprises:

an inflatable bag for dispersing the at least one munition radially outward from a central axis of the core in response to activation of a gas generator.

8. An apparatus as in claim 7, wherein the inflatable bag has multiple expansion lobes.

9. An apparatus as in claim 7, wherein the inflatable bag has two expansion lobes.

10. An apparatus as in claim 8, wherein at least one gas generator is disposed within each of the multiple expansion lobes of the inflatable bag.

11. An apparatus as in claim 8, wherein the munitions are arranged about each of the multiple expansion lobes.

12. An apparatus as in claim 11, wherein a first set of munitions are arranged about a first of the multiple expansion lobes, and a second set of munitions are arranged about a second of the multiple expansion lobes.

13. An apparatus as in claim 11, wherein at least one munition is located between the multiple expansion lobes.

14. An apparatus as in claim 1, further comprising:

a delay element for delaying activation of the multiple gas generators until a preset time period.

15. An apparatus as in claim 1, comprising a delay element for delaying activation of the multiple gas generators until a preset time period, the delay element configured as a solid propellant material located between the propellant charge and one of the multiple gas generators.

16. An apparatus as in claim 1, having a delay element for delaying activation of the expandable device until a preset time period.

17. An apparatus as in claim 15, wherein the ignited solid propellant material is configured to ignite one of the multiple gas generators.

18. An apparatus as in claim 1, wherein the case has an interior at least partially shaped to conform to the outer surfaces of the at least one munition for structural support.

19. An apparatus as in claim 1, wherein the apparatus is a non-spinning projectile.

20. An apparatus as in claim 1, wherein the explosive charge is a flexible linear shape charge arranged within a circumferential groove of a bulkhead of the core, and is aligned to release energy toward the interior wall of the case.

* * * * *